US008959021B2

(12) United States Patent
Kaszczuk et al.

(10) Patent No.: US 8,959,021 B2
(45) Date of Patent: Feb. 17, 2015

(54) SINGLE INTERFACE FOR LOCAL AND REMOTE SPEECH SYNTHESIS

(71) Applicant: IVONA Software Sp. z.o.o., Gydnia (PL)

(72) Inventors: Michal T. Kaszczuk, Gdansk (PL); Lukasz M. Osowski, Gdynia (PL)

(73) Assignee: IVONA Software Sp. z.o.o., Gydnia (PL)

( * ) Notice: Subject to any disclaimer, the term of this patent is extended or adjusted under 35 U.S.C. 154(b) by 231 days.

(21) Appl. No.: 13/720,883

(22) Filed: Dec. 19, 2012

(65) Prior Publication Data

US 2014/0122080 A1 May 1, 2014

(30) Foreign Application Priority Data

Oct. 25, 2012 (PL) ..... 401347

(51) Int. Cl.
*G10L 13/00* (2006.01)

(52) U.S. Cl.
USPC ..... 704/260; 704/258

(58) Field of Classification Search
USPC ..... 704/258, 260
See application file for complete search history.

(56) References Cited

U.S. PATENT DOCUMENTS

| | | | | |
|---|---|---|---|---|
| 7,483,832 | B2 * | 1/2009 | Tischer | 704/260 |
| 8,438,025 | B2 * | 5/2013 | Bahl et al. | 704/235 |
| 2009/0125309 | A1 * | 5/2009 | Tischer | 704/260 |

FOREIGN PATENT DOCUMENTS

WO WO 2011/088053 A2 7/2011

* cited by examiner

*Primary Examiner* — Daniel D Abebe
(74) *Attorney, Agent, or Firm* — Knobbe, Martens, Olson & Bear, LLP

(57) ABSTRACT

Features are disclosed for providing a consistent interface for local and distributed text to speech (TTS) systems. Some portions of the TTS system, such as voices and TTS engine components, may be installed on a client device, and some may be present on a remote system accessible via a network link. Determinations can be made regarding which TTS system components to implement on the client device and which to implement on the remote server. The consistent interface facilitates connecting to or otherwise employing the TTS system through use of the same methods and techniques regardless of the which TTS system configuration is implemented.

30 Claims, 7 Drawing Sheets

SINGLE INTERFACE FOR LOCAL AND REMOTE SPEECH SYNTHESIS

BACKGROUND

Text-to-speech (TTS) systems convert raw text into sound using a process sometimes known as speech synthesis. In a common implementation, a TTS system may be installed on a client device, such as a desktop computer, electronic book reader, or mobile phone. Software applications on the client device, such as a web browser, may employ the TTS system to generate an audio file or stream of synthesized speech from a text input.

In a typical implementation, a TTS system first preprocesses raw text input by disambiguating homographs, expanding abbreviations and symbols (e.g., numerals) into words, and the like. The preprocessed text input can be converted into a sequence of words or subword units, such as phonemes. The resulting phoneme sequence is then associated with acoustic features of a number small speech recordings, sometimes known as speech units. The phoneme sequence and corresponding acoustic features are used to select and concatenate speech units into an audio presentation of the input text.

Different voices (e.g., male American English, female French, etc.) may be implemented as sets of recorded speech units and data regarding the association of the speech units with a sequence of words or subword units. The amount of storage space required to store the data required to implement the voice (e.g., the recorded speech units) may be substantial, particularly in comparison with the limited storage capabilities of some client devices, such as electronic book readers and mobile phones.

BRIEF DESCRIPTION OF DRAWINGS

Throughout the drawings, reference numbers may be reused to indicate correspondence between referenced elements. The drawings are provided to illustrate example embodiments described herein and are not intended to limit the scope of the disclosure.

DETAILED DESCRIPTION

Introduction

Figure 1A:
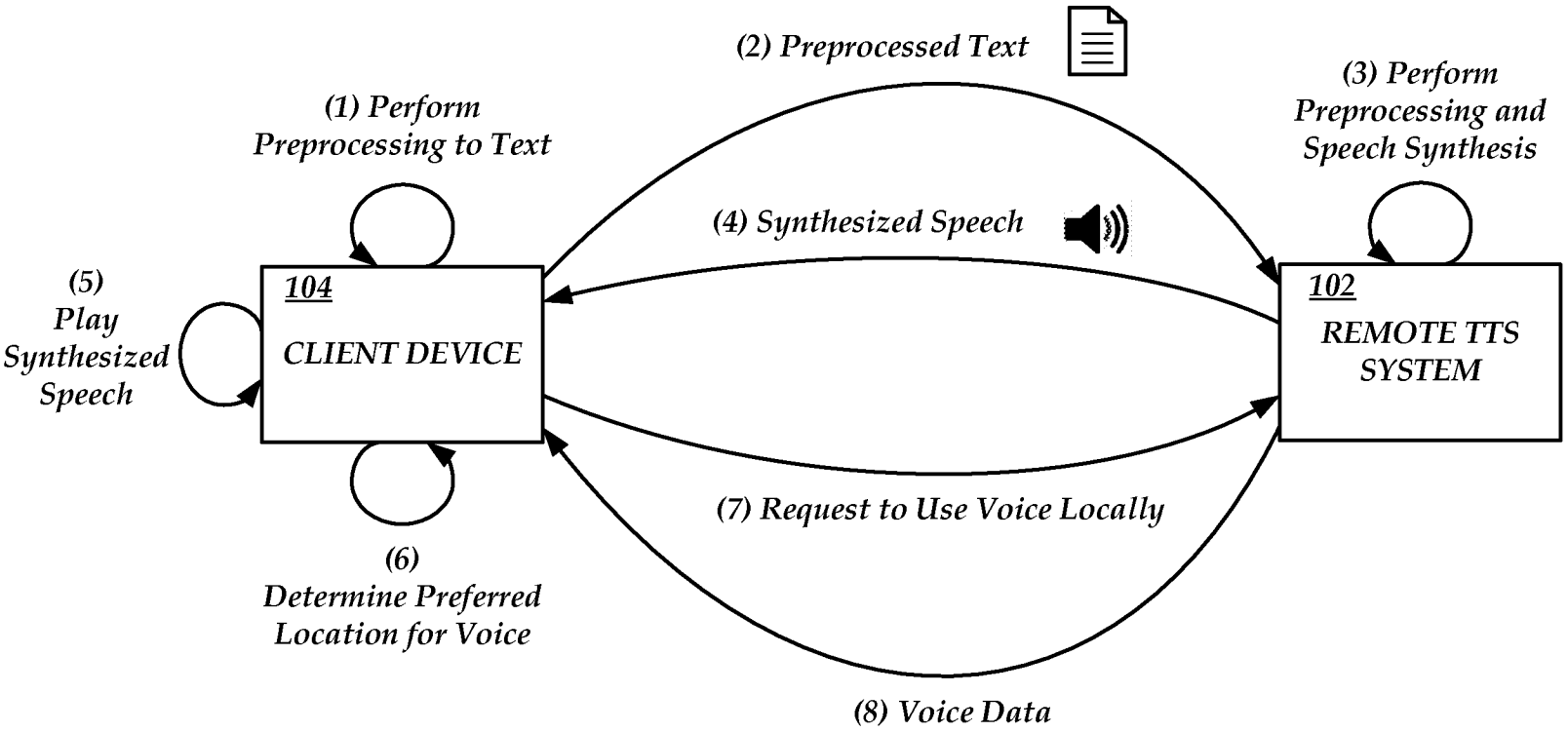
FIG. 1A is a block diagram of illustrative data flows and interactions between a client device and a remote text to speech system where an audio presentation is generated at the remote text to speech system.

Generally described, the present disclosure relates to speech synthesis systems. Specifically, aspects of the disclosure relate to providing a consistent interface for local and distributed text to speech (TTS) systems, and to shielding application developers and end users from the implementation details of TTS systems. A TTS system may include an engine that converts textual input into synthesized speech, conversion rules which are used by the engine to determine which sounds correspond to the written words of a language, and voices which allow the engine to generate an audio presentation in a language with a specific voice (e.g., a female voice speaking American English). In some embodiments, each component of the TTS system may be installed on a client device for use by other applications on the client device. In additional embodiments, some portions of the TTS system may be installed on a client device, and some, such as data corresponding to one or more voices (voice data) in which audio presentations can be generated, may be present on a remote system accessible via a network link. A consistent interface to the TTS system, such as an application programming interface (API), may be provided in these and any number of other TTS system configurations. The consistent interface facilitates connecting to or otherwise employing the TTS system through use of the same methods and techniques regardless of the which TTS system configuration is implemented.

Additional aspects of the disclosure relate to determining which TTS system components, such as voices and preprocessing components, to implement on a client device and which to implement on a remote server. Each implementation configuration may be utilized by application developers and end users through the single consistent API.

Although aspects of the embodiments described in the disclosure will focus, for the purpose of illustration, on interactions between a remote text to speech system and client computing devices, one skilled in the art will appreciate that the techniques disclosed herein may be applied to any number of hardware or software processes or applications. Further, although various aspects of the disclosure will be described with regard to illustrative examples and embodiments, one skilled in the art will appreciate that the disclosed embodiments and examples should not be construed as limiting. Various aspects of the disclosure will now be described with regard to certain examples and embodiments, which are intended to illustrate but not limit the disclosure.

With reference to an illustrative embodiment, an application developer (e.g., developer of an ebook reading application) may wish to provide TTS functionality to users of an application. The application developer may build such functionality into the application, which can be a time consuming process. Alternatively, the developer may utilize a specialized TTS system. Specialized TTS systems may provide better performance, a greater variety of languages and voices, and other desirable features that can be difficult to effectively implement as a secondary feature of an application.

A TTS system may include tens or hundreds of different voices and different languages. The data required to implement a particular voice may consume a substantial portion of storage available on a client device, particularly mobile devices such as tablet computers and mobile phones. Accordingly, only a small number of voices may be included in a local installation of a TTS system on such devices. A remote TTS system accessible via a network link may include an entire catalogue of voices and languages. The number of voices and languages may be limited only by the substantial resources available in data center environments and the ability of voice and language developers to create the necessary data and recorded speech units. One problem, among others, presented by the use of a remote network-accessible TTS system is the network latency inherent in the utilization of many remote systems.

A TTS voice may be specified or requested in a variety of ways. For example, a voice may be specified as a gender and a language (e.g., male U.S. English) but it need not be a specific male U.S. English speaker (sometimes denoted with specific names, such as "Jeremy" or "Andrew") and it need not use any particular TTS algorithm (such as unit selection or statistical parametric-based TTS). Alternatively, the voice "Jeremy" for U.S. English may be explicitly specified. Further, the voice "Jeremy" for U.S. English using a unit selection TTS could also be requested. In some situations, only the language and the TTS method may be specified, such as French, hidden Markov model (HMM) based TTS. One of skill in the art will appreciate that voices may be specified or requested any combination of the above parameters or using other parameters as well.

A distributed TTS system with features implemented at the local client device, at a remote server, or both can provide the advantages of both client-side TTS systems and remote TTS systems. For example, a distributed TTS system with at least one voice stored on the client device can be used to generate synthesized speech even in the absence of a network connection or in cases where network latency is unacceptable. Adding the capability to utilize a remote TTS system can provide access to an entire catalogue of voices when a network connection is available and when network latency is not a concern.

A single interface, such as an API, may be provided to access the TTS system regardless of whether features of the system are implemented entirely on a client device or distributed between a client and a remote server. Application developers may leverage the single interface and access TTS features without prior knowledge of the actual TTS system implementation. An application developer may utilize such a distributed TTS system by configuring an application to access the single API of the distributed TTS system, transmit text input, and receive a synthesized speech output from the system. The developer may not know whether the voice data utilized to generate the speech is stored locally or remotely. The TTS system may be implemented so as to shield the developer and end user from the location of processing or storage, returning a similar or substantially identical output from a given text input regardless of where the voice data is stored, where TTS processing occurs, or where the synthesized speech output is generated. In some situations, the local device may provide lower quality TTS output than a remote TTS system. For example, the local device may use a statistical parametric-based TTS engine, such as a hidden Markov model based TTS engine, which has a low footprint but also produces lower quality output, while the remote TTS system may utilize a unit selection-based TTS engine which is higher quality and also has a higher storage footprint.

In some embodiments, it may be desirable or required to implement certain processing features only on the client device, even though the benefits of using a remote TTS system such as expanded storage are also desired. For example, some of the text processing functions may be provided by an operating system and may be used in a local TTS system. Those functions may be difficult to implement correctly in a remote TTS system, particularly when the remote TTS system is configured to provide speech synthesis to a number of different client devices configured with any of a number of different operating systems and other application software. Accordingly, the processing may be split in some installations between the TTS system on the client device and the remote TTS system. The component of the TTS system on the client device may obtain input and perform text preprocessing operations, utilizing various operations that may be unique to the operating environment of the client device. The output of the local TTS components may be preprocessed text that is similar or substantially identical to the output that may be produced by the TTS system operating on a different client device with a different operating system or application software. The preprocessed text may then be transmitted to the remote TTS system for speech synthesis, which will produce an audio file or stream that will be similar or substantially identical, for a given text input, regardless of the type of client device from which the text was received. Developers may be assured that their applications will receive consistent TTS output regardless of the specific environment in which the developers' applications are executing.

Example Data Flows and Interactions

FIG. 1A illustrates sample data flows and interactions between a client device 104 and a remote TTS system 102. An application on the client device 104 can request TTS processing of a text input. For example, an electronic book reading application may send some or all of the text of an ebook to a local TTS system on the client device 104 (e.g.: to the local TTS engine 142 illustrated in FIG. 2) to synthesize speech from the ebook text. The local TTS system can perform preprocessing of the text input at (1) according a predetermined configuration, as described in detail below with respect to FIGS. 3 and 4. Generally described, preprocessing of the text may include stripping formatting, resolving ambiguities, expanding abbreviations, converting the text to subword units, or some combination thereof.

If the voice data required to synthesize speech from the preprocessed text in the desired voice is not available locally to the local TTS system, or if a network connection of sufficient bandwidth and latency is available to connect to a remote TTS system 102, the local TTS system or some other component of the client device 104 may automatically employ the remote TTS system 102 to generate synthesized speech in the desired voice. Accordingly, the client device 104 can transmit the preprocessed text at (2) to the remote TTS system 102. The transmission may occur via the internet or some other network (e.g.: network 110 of FIG. 2), and the text may be transmitted as a stream of preprocessed text, as an Extensible Markup Language (XML) file, or any other format that facilitates network transmission of data. When the voice data is available locally on the client device 104, or when no acceptable network connection is available, the local TTS system may synthesize the speech and initiate playback without any transmission to or from the remote TTS system 102.

The remote TTS system 102 may perform any final preprocessing left to be completed, as described below with respect to FIGS. 3 and 4, and then synthesize speech from the fully preprocessed text at (3). The synthesized speech can be transmitted to the client device 104 at (4). In some embodiments, the synthesized speech can be transmitted as an audio file or as a stream of audio content. The client device 104 can receive and initiate playback of the synthesized speech at (5).

The client device 104 may determine at (7) that one or more voices are preferably stored on the client device 104. For example, a component of the local TTS system or some other component on the client device (e.g.: the analysis component 150 of FIG. 2) may determine that a particular voice is utilized via the remote TTS system 102 more often than a locally available voice. In some cases, a user of a client device 104 may wish to store voices locally that are currently only available via the remote TTS system 102. For example, a user may desire, for handicap accessibility purposes, one or more voices to be stored locally in order to reduce the latency that a TTS system distributed over a network computing environment introduces. In these and other cases, the user or some component of the client device 104 can transmit a request to the remote TTS system 102 at (7) to retrieve and store the data required to implement the voice locally. Alternatively, or in addition, an analysis component or some other component of the remote TTS system 102 may determine that local storage of the voice data on the client device 104 is desirable. In either case, the remote TTS system 102 may transmit voice data at (8) to the client device 104. As a result, the local TTS system may fully synthesize speech in the newly received voice without any transmission to or from the remote TTS system 102. In some embodiments, the client device 104 may transmit usage data to the remote TTS system 102 even in cases where a locally stored voice is utilized. Such usage data may be valuable to the remote TTS system in determining optimal or desired deployment locations for voices in the future, as described below with respect to FIG. 5.

Figure 1B:
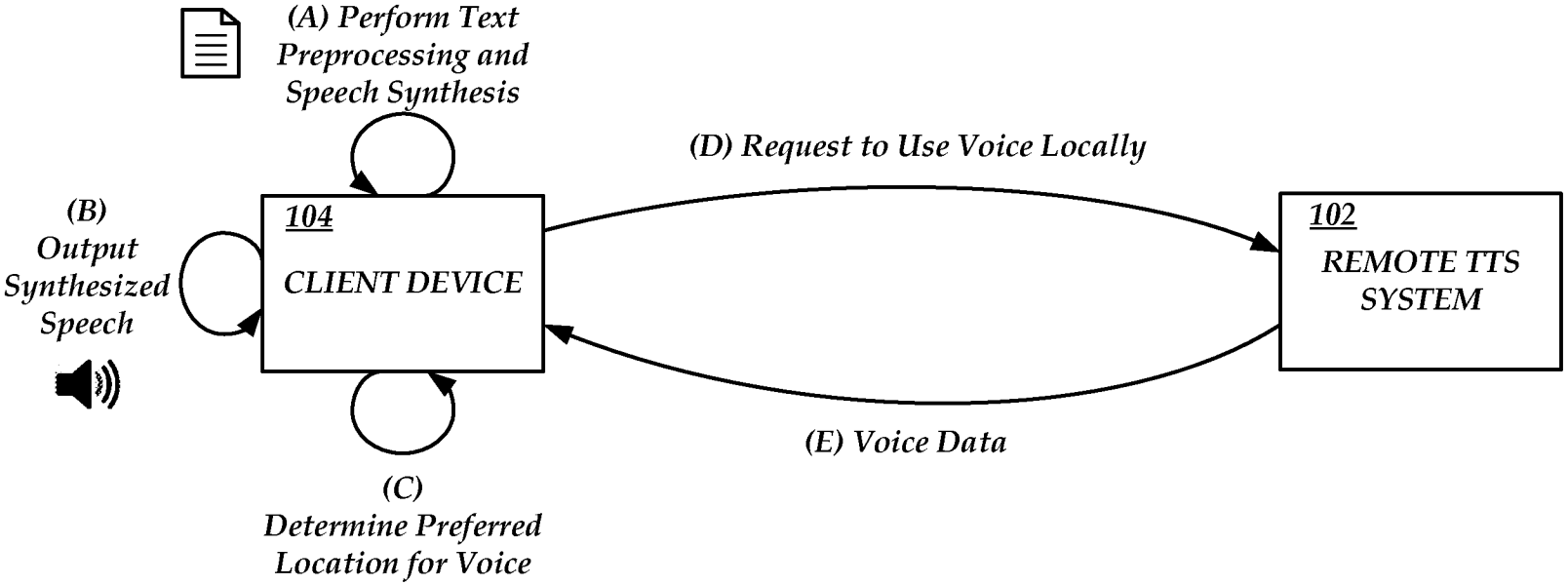
FIG. 1B is a block diagram of illustrative data flows and interactions between a client device and a remote text to speech system where an audio presentation is generated at the client device.

FIG. 1B illustrates alternative sample data flows between a client device 104 and a remote TTS system 102, such as might occur if the client device 104 has voice data available locally. The client device may perform text preprocessing and fully synthesize speech using the selected voice at (A). The client device 104 may then output the synthesized speech at (B), such as through a speaker, by saving to a file, or some other output method. A component of the client device 104 (e.g.: the analysis component 150 illustrated in FIG. 2) may determine at (C) that that preferred location for a voice, such as a voice related to the one used to prepare synthesize the speech at (A), or one requested by an end user or application, is on the client device. Accordingly, the client device 104 may request to use the voice locally at (D), and receive the voice data from a remote TTS system 102 at (E).

In some embodiments, the client device 104 may determine that one or more voices stored on the client device 104 are more preferably accessed from the remote TTS system 102. For example, a voice that is not used often (or at all) but which takes up storage space on the client device 104 may be removed from the client device 104. Future requests to synthesize speech using that voice will be serviced in conjunction with the remote TTS system 102. The client device 104 may determine at a later time that the voice is to be stored on the client device 104, and retrieve the voice data for storage in the local TTS system.

Network Computing Environment

Figure 2:
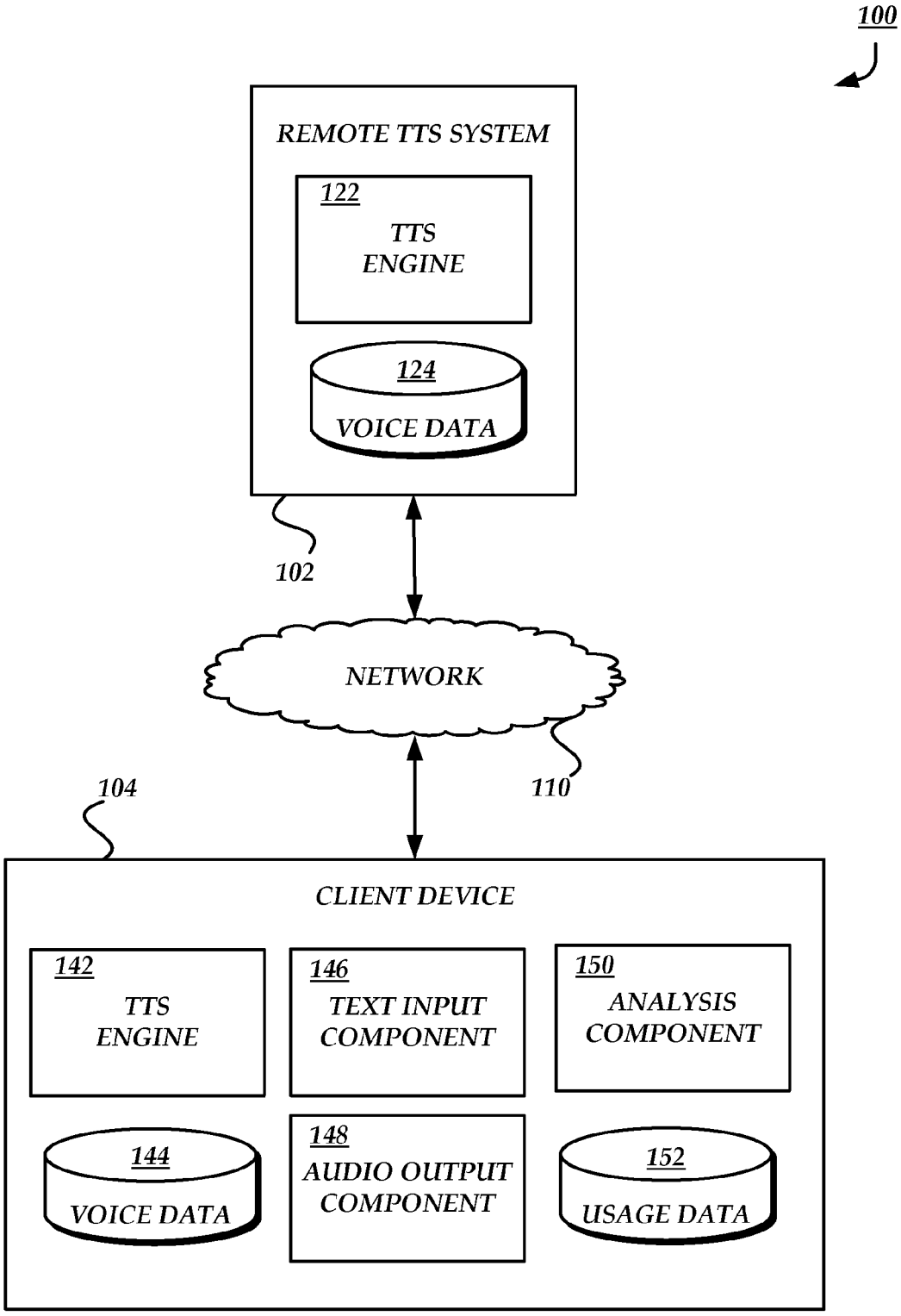
FIG. 2 is a block diagram of an illustrative network computing environment including a remote text to speech system and a client device.

Turning now to FIG. 2, an example network computing environment in which these features can be implemented will be described. FIG. 2 illustrates a network computing environment 100 including a remote TTS system 102 and a client device 104 in communication via a network 110. In some embodiments, the network computing environment 100 may include additional or fewer components than those illustrated in FIG. 2. For example, the number of client devices 104 may vary substantially, and the remote TTS system 102 may communicate with two or more client devices 104 substantially simultaneously.

The network 110 may be a publicly accessible network of linked networks, possibly operated by various distinct parties, such as the Internet. In other embodiments, the network 110 may include a private network, personal area network, local area network, wide area network, cable network, satellite network, etc. or some combination thereof, each with access to and/or from the Internet.

The remote TTS system 102 can include any computing system that is configured to communicate via network 110. For example, the remote TTS system 102 may include a number of server computing devices, desktop computing devices, mainframe computers, and the like. In some embodiments, the remote TTS system 102 can include several devices or other components physically or logically grouped together. The remote TTS system 102 illustrated in FIG. 2 includes a TTS engine 122 and a voice data store 124.

The TTS engine 122 may be implemented on one or more application server computing devices. For example, the TTS engine 122 may include an application server computing device configured to process input in various formats and generate audio files or steams of synthesized speech.

The voices data store 124 may be implemented on a database server computing device configured to store records, audio files, and other data related to the generation of a synthesized speech output from a text input. In some embodiments, voice data is included in the TTS engine 122 or a separate component, such as a software program or a group of software programs.

The client device 104 may correspond to any of a wide variety of computing devices, including personal computing devices, laptop computing devices, hand held computing devices, terminal computing devices, mobile devices (e.g., mobile phones, tablet computing devices, etc.), wireless devices, electronic book (ebook) readers, media players, and various other electronic devices and appliances. The term "ebook" is a broad term intended to have its broadest, ordinary meaning. In some embodiments, the term "ebook" refers to any publication that is published in digital form. For example, an ebook can refer to a book, magazine article, blog, posting, etc., that is or can be published, transmitted, received and/or stored, etc., in electronic form. A client device 104 generally includes hardware and software components for establishing communications over the communication network 110 and interacting with other network entities to send and receive content and other information.

The client device 104 illustrated in FIG. 2 includes a TTS engine 142, a voice data store 144, a text input component 146, an audio output component 148, an analysis component 150, and a usage data store 152. As will be appreciated, the client device 104 may contain many other components, such as one or more central processing units (CPUs), random access memory (RAM), hard disks, video output components, and the like. The description of the client device 104 herein is illustrative only, and not limiting.

The TTS engine 142 on the client device 104, also referred to as the local TTS engine 142, may be substantially similar to the TTS engine 122 of the remote TTS server 102, also referred to as the remote TTS engine 122. In some embodiments, TTS engine 122 may be an embedded TTS engine and may be customized to run on devices with fewer resources, such as memory or processing power. For example, the TTS engine 142 may be configured to process input in various formats, such as an ebook or word processing document obtained from the text input component 146, and generate audio files or streams of synthesized speech. The operations that the local TTS engine 142 performs may be substantially identical to those of the remote TTS engine 122, or the local TTS engine 142 may be configured to perform operations which create substantially identical output as the remote TTS engine 122. In some cases, the processing actions performed by the local TTS engine 142 may be different than those performed by the remote TTS engine 122. For example, the local TTS engine 142 may be configured to perform HMM-based TTS operations, while the remote TTS engine 122 performs unit selection-based TTS operations. In some embodiments, the local TTS engine 142 or the remote TTS engine 122 may be configured to perform both unit selection and statistical parametric (e.g., HMM) based TTS operations, depending on the circumstances and the requirements of the applications and end users.

The voices data store 144 of the client device 104 may correspond to a database configured to store records, audio files, and other data related to the generation of a synthesized speech out from a text input. In some embodiments, voice data is included in the TTS engine 142 or a separate component, such as a software program or a group of software programs.

The text input component 146 can correspond to one or more software programs or purpose-built hardware components. For example, the text input component 146 may be configured to obtain text input from any number of sources, including electronic book reading applications, word processing applications, web browser applications, and the like executing on or in communication with the computing device 104. In some embodiments, the text input component 146 may obtain an input file or stream from memory, a hard disk, or a network link directly (or via the operating system of the computing device 104) rather than from a separate application. The text input may correspond to raw text input (such as ASCII text), formatted text input (e.g., web-based content embedded in an HTML file), and other forms of text data.

The audio output component 148 may correspond to any audio output component commonly integrated with or coupled to a computing device 104. For example, the audio output component 148 may include a speaker, headphone jack, or an audio line-out port.

The usage data store 152 may be configured as a database for storing data regarding individual or aggregate executions of the local TTS engine 142. For example, data may be stored regarding which application requested an audio presentation, what voice was used, measurements of network latency if the remote TTS system 102 is utilized, and the like. The analysis component 150 may utilize usage data 152 to determine the optimal or desired location for voices, and can retrieve voice data from the remote TTS system 102 for storage in the local voice data store 106 if it is determined that a particular voice or voices are to be available locally.

In some embodiments, the remote TTS system 102 may be configured to track TTS requests and determine the optimal or preferred location for voice data instead of or in addition to the client device 104. For example, the remote TTS system may include an analysis component, similar to the analysis component 150 of the client device 104. The analysis component can receive requests for TTS services, analyze the requests over time, and determine, for a particular client device 104, or for a group of client devices 104, which voices may be optimally stored locally at the client device 104 and which may be optimally stored remotely at the remote TTS system 102.

TTS Processing in a Network Environment

Figure 3:
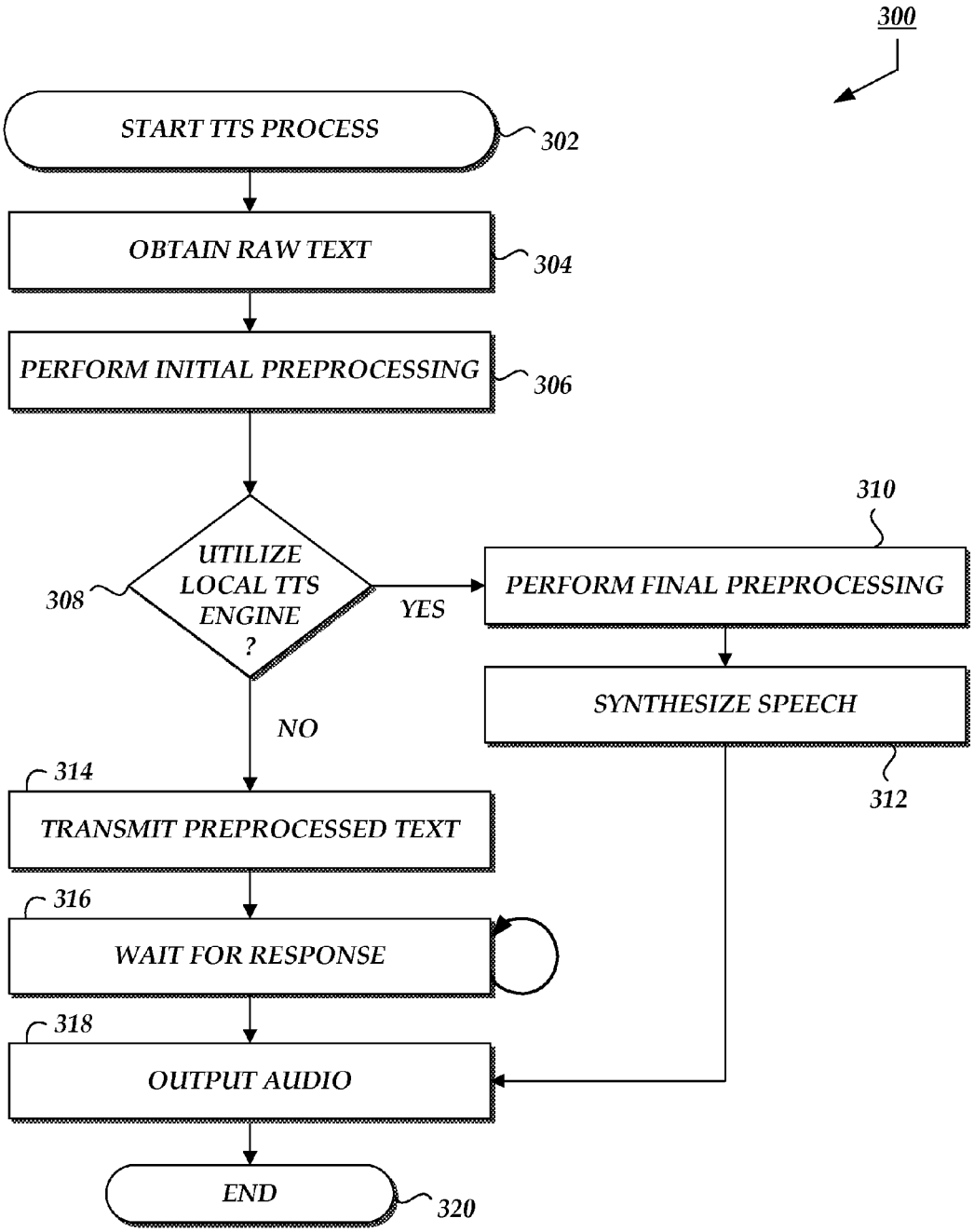
FIG. 3 is a flow diagram of an illustrative process for performing text to speech in a network environment.

Turning now to FIG. 3, an illustrative process 300 for generating synthesized speech in a distributed TTS system will be described. The process 300 may be implemented by a local TTS engine 142 or some other component or collection of components on the client device 104. A single API may be exposed to applications of the client device 104. Applications may access the TTS functionality of the local TTS engine 142, the remote TTS engine 122, or some combination thereof through the single API. In addition, various techniques (e.g.: HMM, unit selection) may be implemented by the local TTS engine 142 or the remote TTS engine 142 to create audio presentations. The single API can choose the optimal or preferred TTS engine or technique to utilize in order to generate the audio presentation, based on factors such as the location of voice data, the availability of a network connection, and other characteristics of the client device 104. The characteristics of the client device 104, may include characteristics of resources available to the client device 104, such as a network connection, and may include characteristics of applications on the client device 104 or applications using the TTS services of the client device 104. Applications and end users may be shielded from the determinations made by the single API such that an audio presentation of a given text input is obtained through the same command or other programmatic interface regardless of which TTS engine or technique is used to create it.

A single set of components, such as executable code modules, may be installed on a client device 104. Configuration settings may be used to indicate which processing occurs on the client device 104. Alternatively, customized code modules may be installed on a client device 104 depending on the desired configuration. The local TTS engine 142 may be configured to perform some portion of text preprocessing, while transmitting the partially preprocessed text to a remote TTS system 102. In some embodiments, the local TTS engine 142 may be configured to perform all text preprocessing before transmitting the preprocessed text to a remote TTS system 102. In further embodiments, the local TTS engine 142 may be configured to perform all preprocessing and speech synthesis, with no transmission to a remote TTS system 102.

The process 300 of generating synthesized speech in a distributed TTS system via a single API begins at block 302. The process 300 may be executed by a local TTS engine 142 or some other component of the client device 104. In some embodiments, the process 300 may be embodied in a set of executable program instructions and stored on a computer-readable medium drive associated with a computing system. When the process 300 is initiated, the executable program instructions can be loaded into memory, such as RAM, and executed by one or more processors of the computing system. In some embodiments, the computing system may include multiple processors, and the process 300 may be executed by two or more processors, serially or in parallel.

Initiation of the process 300 may occur in response to the receipt of a programmatic command, such as an API call, performed by an application on the client device 104, such as an ebook reading application. The local TTS engine 142 may expose a single API to the programs and processes executing on the client device 104. An application, such as the ebook reading application described above, may programmatically initiate the process 300 by executing an API call. For example, the API may expose a method with the signature generate_speech (filename). In this pseudo code example, generate_speech is the name of the method that a program uses to make the API call, and filename is a parameter that is used to pass the name or location of the text input from which to generate synthesized speech. The API may expose a second method to initiate the TTS process. The second method may have the signature generate_speech (rawtext), where the parameter rawtext is used to pass in a string or memory buffer containing the text from which to synthesis speech. The same two methods, with the same signatures, may be used across any number of different implementations of the local TTS engine 142, thereby providing consumers of TTS services— e.g., the applications of the client device 104—a consistent way to initiate the process 300. Applications and processes on the client device 104 may instantiate one or more instances of the local TTS engine, and invoke one of the methods to begin TTS processing.

Figure 4A:
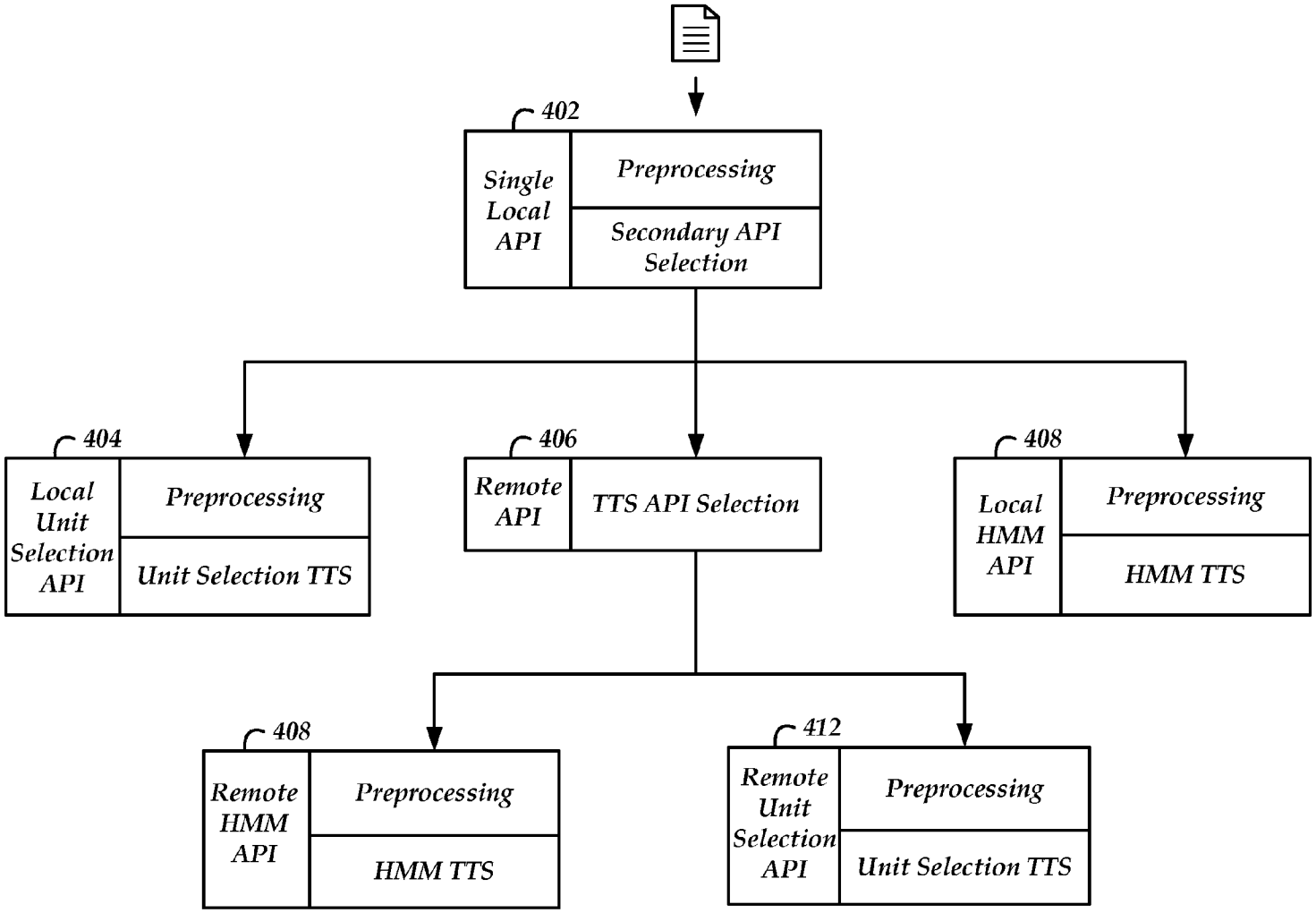
FIG. 4A is a block diagram of a single local application programming interface (API) and the various secondary APIs that may be accessed via the single local API.

At block 304, the local TTS engine 142 may obtain the raw text to be processed. Returning to the previous example, the ebook reading application may utilize the API to transmit raw text to the text input component 146 or some other component of the client device 104 associated with the local TTS engine 142. Alternatively, the ebook reading application may utilize the API to specify a file, memory buffer, or other physical or logical location from which to retrieve the raw input text. FIG. 4A illustrates the receipt of text by a single local API 402 regardless of which TTS engine (e.g.: local TTS engine 142, remote TTS engine 122) or technique (e.g.: HMM, unit selection) is utilized to generate the audio presentation of the text. As seen in FIG. 4A, the single local API 402 may include a module for performing preprocessing operations and for determining which secondary API to utilize when generating the audio presentation.

At block 306, the local TTS engine 142 may perform initial preprocessing of the raw text input, if it is configured to do so according to the single local API. Generally described, preprocessing of text for speech synthesis can involve a number of operations. For example, one embodiment of a TTS system may implement at least three preprocessing operations, including (A) expansion of abbreviations and symbols into words, (B) disambiguation of homographs, and (C) conversion of the text into a subword unit (e.g., phoneme) sequence. The same embodiment may implement conversion of the preprocessed text into synthesized speech utilizing any number of additional operations, including concatenation of recorded speech segments into a sequence corresponding to the phoneme sequence to create an audio presentation of the original text. Other embodiments of TTS systems may implement any number of additional or alternate operations for preprocessing of input text. The examples described herein are illustrative only and not limiting.

As seen in FIG. 4A, the single local API 402 may include a module for performing preprocessing operations and a module for determining which secondary API to utilize when generating the audio presentation. Depending on the capabilities of the client device 104, the desired performance of the TTS system and other factors, various implementations may split the processing between the local TTS engine 142 and remote TTS engine 122 differently. The single local API 402 or the local TTS engine 142 may determine which configuration to use based on configuration settings, or the local TTS engine 142 may be customized to operate according to a single configuration.

Figure 4B:
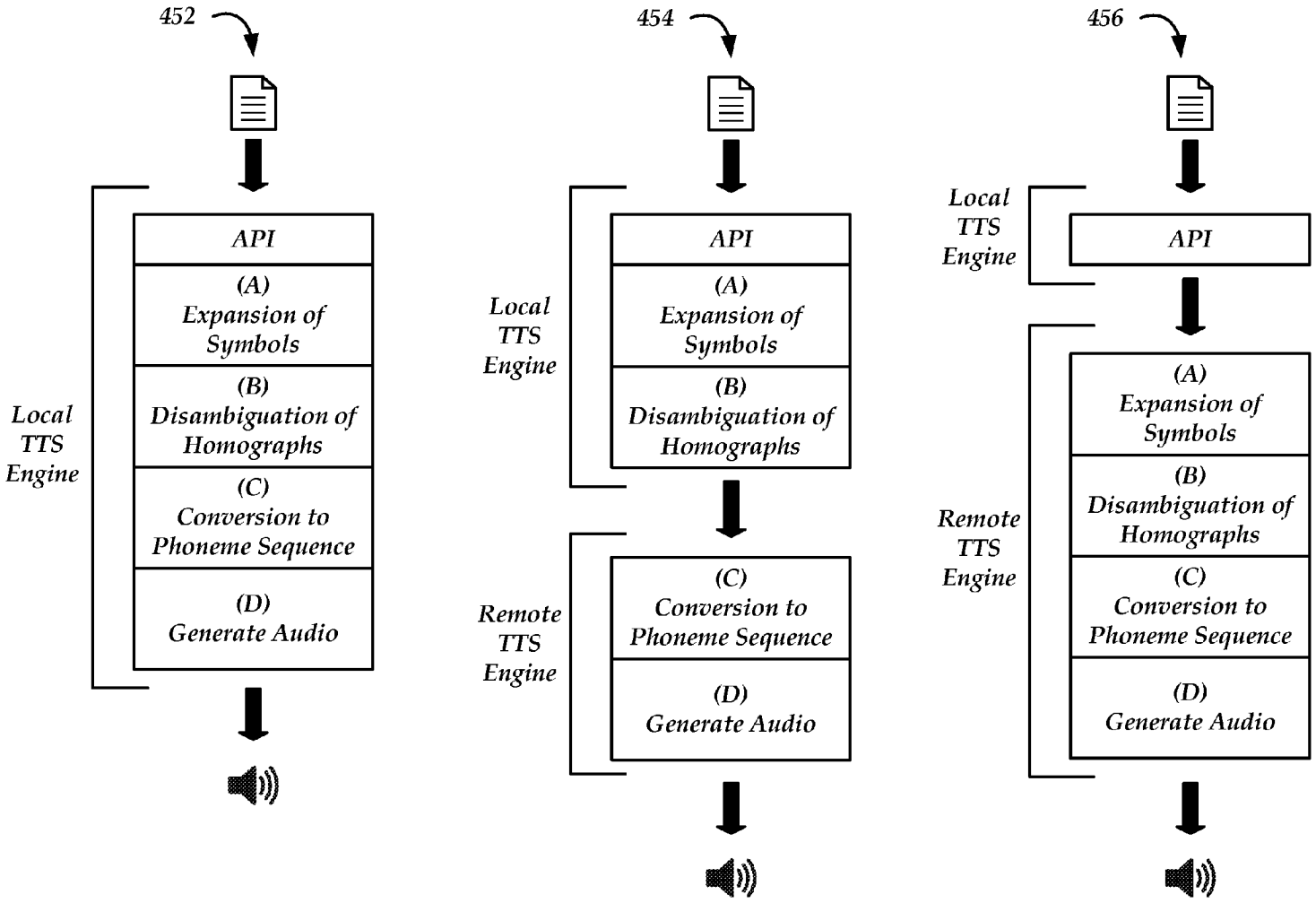
FIG. 4B is a block diagram of several illustrative text to speech implementations which may be accessed through a single local API.

FIG. 4B shows three illustrative splits of TTS operations between the local TTS engine 142 and the remote TTS engine 122. Configuration 452 shows the local TTS engine 142 performing all preprocessing tasks and also generating the synthesized speech. Such a configuration may be used when the client device 104 has a substantial amount of available storage in which to store data for various voices. Alternatively, such a configuration may be used in cases where a client device 104 has less storage if a user of the client device 104 only utilizes a single voice or a small number of voices, if a user of the client device 104 uses HMM-based TTS (which may require less storage), if a user of the client device 104 prefers lower latency, or if a network connection is not available.

Configuration 454 shows the local TTS engine 142 performing preprocessing tasks (A) and (B), described above, while the remote TTS engine performs the last preprocessing task (C) and the speech synthesis (D). Such a configuration may be used when certain operations required or desired to perform tasks (A) or (B) are implemented on the client device 104, such as within the operating system, and are difficult to implement at a remote TTS system 102.

Configuration 456 shows the remote TTS engine performing all of the text preprocessing and the speech synthesis. Such a configuration may be used when computing capacity of the client device 104 is limited (e.g., mobile phones). A single or small number of preprocessing tasks may continue to be performed on the client device 104 when, for example, certain operations are difficult to perform in at the remote TTS system 102 in the same way, or when there is a user-customizable feature of the TTS system. In some embodiments, users may define their own lexicon or other customizable features. Accordingly, performance of operations regarding those customizable features may remain on the client device 104 when it is difficult to efficiently and consistently apply those customizations at the remote TTS system 102.

At decision block 308, the secondary API selection module of the single local API 402 or some other component of the local TTS engine 142 determines whether to utilize the local TTS engine 142 or the remote TTS engine 122. The secondary API selection module may select which TTS system (e.g.: the local TTS engine 142 or the remote TTS engine 122) and which technique (e.g.: HMM, unit selection) to utilize based one or more factors, including the presence of voice data for the selected voice on the client device 104, the existence of a network connection to a remote TTS system 102, characteristics of the network connection, characteristics of the requesting application, and the like.

For example, a threshold determination may be whether the voice selected by the user or application requesting the audio presentation is present on the client device 104 (e.g.: stored in the voice data store 144). If it is not, then the secondary API selection module may employ the remote TTS system 102, as shown in FIG. 4A. One factor to consider before determining to utilize the remote TTS system 102 is whether there is a network connection available with which to exchange data with the remote TTS system 102. Additionally, characteristics of the network connection may be considered, such as bandwidth and latency. If there is not a network connection available, or if the characteristics of the network connection are not acceptable, then a different voice available to the local TTS engine 142 may be chosen instead of the selected voice, or the application that requested the audio presentation may be notified that the selected voice is not currently available.

In some embodiments, it may be determined to use a particular voice, such as a male, U.S. English voice. If the voice is available to the local TTS engine 142 (e.g.: stored in the voice data store 144), the secondary API selection module 402 may employ the local TTS engine 142 to generate the audio presentation utilizing the voice. In some embodiments, the local voice and TTS engine may utilize an HMM voice and TTS engine 408. HMM-based TTS may not provide the same level of quality as other techniques, such as those utilizing unit selection. In such cases, the secondary API selection module may determine whether a network connection is available with which to employ a remote TTS engine 122 configured to utilize a unit selection voice and TTS engine 412 to generate the audio presentation. Characteristics of the network connection may also be considered, as described above. In addition, characteristics of the requesting application may also be considered. For example, if the application is a handicap accessibility application, any network latency may be unacceptable or undesirable. In such cases, even though a network connection may be available, with relatively low latency, to a remote TTS system that utilizes unit selection to generate audio presentations with the selected voice, the secondary API selection module may still choose to utilize the lower quality HMM version 408 available locally.

At block 310, the local TTS engine 142 can perform any remaining preprocessing according to the single local API 402, such as the preprocessing that was not performed as described above with respect to block 306. The local TTS engine 142 may proceed to perform all of the preprocessing steps, and the preprocessing steps may depend on the particular local API selected. For example, the preprocessing steps for a local unit selection API 404 may be different from preprocessing steps for local HMM API 408. Following the completion of any preprocessing steps, the process 300 may proceed to the speech synthesis step at block 312, as shown in configuration 452 of FIG. 4B.

In response to determining that to utilize a remote TTS system 102 to generate the audio presentation, local TTS engine 142 can transmit the text, or a preprocessed version of the text, to the remote TTS engine at block 314. The local TTS engine 142 can then wait for a response from the remote TTS system 102 at block 316.

At block 318, the local TTS engine 142 can output the generated audio presentation. For example, the local TTS engine 142 can cause playback of the synthesized speech to the audio output component 318. The local TTS engine 142 may do so in response to receiving synthesized speech from the remote TTS engine, or in response to generating the synthesized speech locally. In some embodiments, the local TTS engine 142 may output the audio presentation to a file instead of audio output component 318. Upon completion of audio output, the process 300 may terminate at block 320.

In some embodiments, the process 300 may be executed any number of times in sequence. For example, if an ebook reader application employs the local TTS engine 142 to generate speech synthesis for a play, a different voice may be used for each character. In such cases, the application can transmit a series of text portions to the local TTS engine 142 with instructions to use a different voice for each line, depending on the character. The client device may have some voices present locally in the voice data storage 144, and may connect to the remote TTS engine 122 for those voices which are not stored locally.

In some embodiments, multiple instances of the process 300, or of the local TTS engine 142, may be executed substantially concurrently. In such cases, it may not be desirable for each instance to initiate overlapping playback of synthesized speech. Accordingly, some synthesized speech may be queued, buffered, or otherwise stored for later playback.

Automatic Determination of Voice Storage Location

Figure 5:
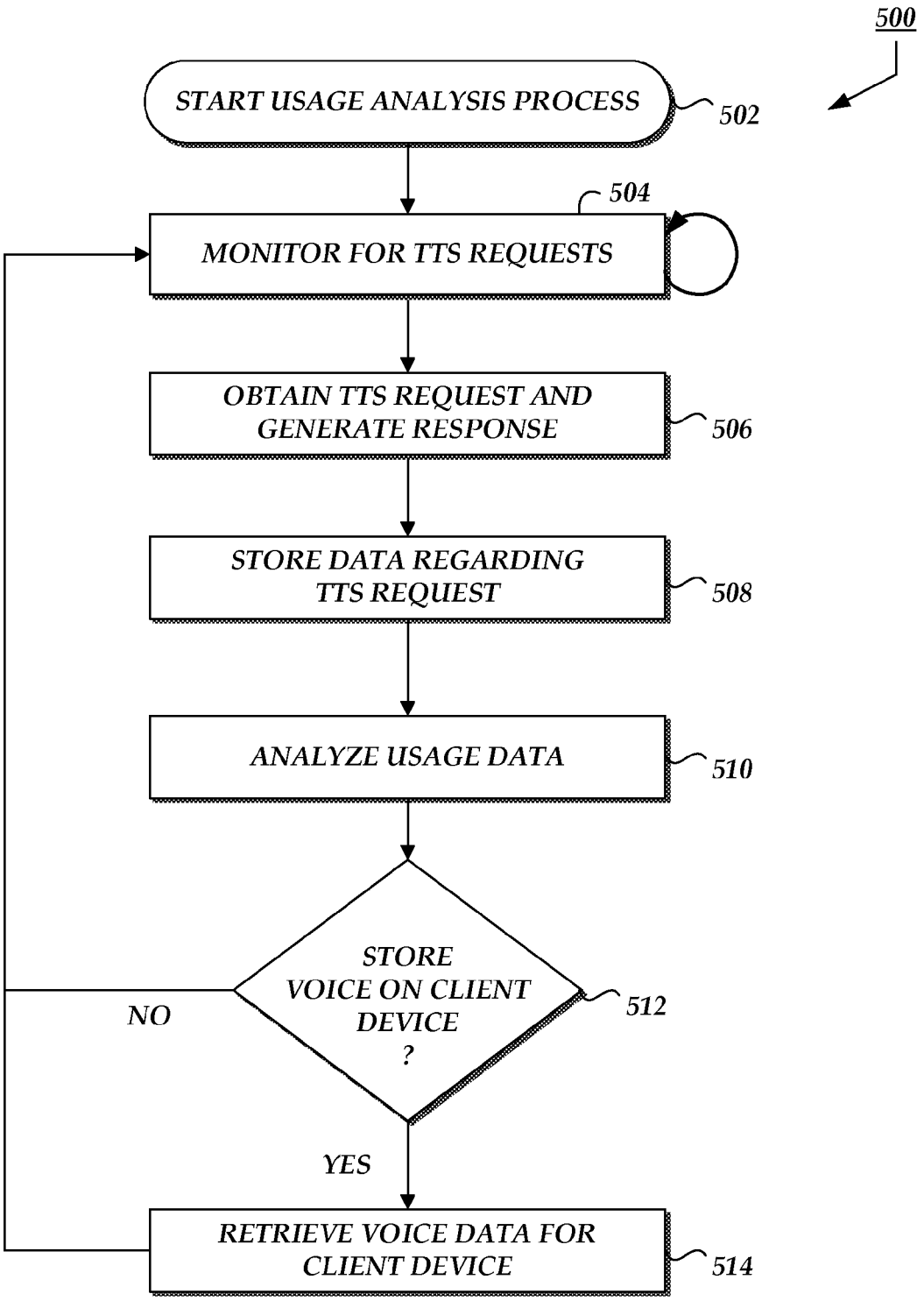
FIG. 5 is a flow diagram of an illustrative process for determining which voices to optimally store locally on a client device.

Turning now to FIG. 5, an illustrative process 500 for analyzing TTS usage and automatically determining the optimal or otherwise preferred location of voice data will be described. The process 500 may be implemented by an analysis component 150 or some other component of a client device 104. The analysis component 150 may obtain data regarding usage of the local TTS engine 142, local voice data 144, the remote TTS system 102, and remote voice data 124. The analysis component 150 may perform various analyses on the data to determine whether a voice may be more efficiently utilized from local storage on a client device 104, and whether storage space utilized for a voice on a client device 104 may be more effectively utilized for other purposes by accessing the voice through the remote TTS system 102. In some embodiments, the process 500 or another similar process may be utilized by a remote TTS system 102 to determine whether a voice is optimally or preferably available to a local TTS engine 142 or via the remote TTS system 102, and to transmit voice data to the client device 104 or instruct the client device 104 to remove voice data.

The process 500 of analyzing usage data and determining preferable locations for voice data begins at block 502. The process 500 may be executed by an analysis component 150 or some other component of the client device 104. In some embodiments, the process 500 may be embodied in a set of executable program instructions and stored on a computer-readable medium drive associated with a computing system. When the process 500 is initiated, the executable program instructions can be loaded into memory, such as RAM, and executed by one or more processors of the computing system. In some embodiments, the computing system may include multiple processors, and the process 500 may be executed by two or more processors serially or in parallel.

At block 504, the analysis component 150 may monitor the local TTS system for TTS requests received from applications executing on the client device 104. If a request is received at block 506, the single local API 402 may initiate processing and generating of the audio presentation in response to the request, as described above.

At block 508, the analysis component 150 can store data regarding the TTS request. The data may be stored in the usage data store 152 or some other component of the client device 104 or otherwise accessible to the analysis component 150.

At block 510, analysis component 150 can analyze the usage data 152 and determine whether a voice is preferably stored on a client device 104 or accessible via the remote TTS system 102. For example, the analysis component 150 can retrieve, from the usage data store 152, any number of records regarding usage one of one more voices located on the client device 104 or at the remote TTS system 102. The analysis component 150 can utilize various analysis techniques, such a statistical profile of each voice that a specific application or group of applications typically utilize, network connectivity and latency when utilizing a remote voice or choosing to utilize a local voice, and the like. Data about the client device 104 may also be obtained, such as amount of storage available. Based on the received data, the analysis component 150 can determine that, for example, a voice that is used everyday should be stored locally on the client device 104, while a voice that is currently stored on the client device 104 but is never used should be remote from the client device 104. Subsequent TTS requests for the second voice will be routed to the remote TTS system 102 for processing and speech synthesis, as described above with respect to FIG. 3.

In another example, the analysis component 150 may determine that a voice that is accessed via a remote TTS system 102 should be saved on the client device 104 even though it may not often be used. Such a determination may be based on the lack of an acceptable network connection with the remote TTS system 102 when use of the voice is desired or on the availability of storage space and computing capacity on the client device 104 sufficient to store voice data for generating high quality voices. In a further example, the analysis component 150 may determine that a voice is to be utilized via the remote TTS system 102 even though it is often used. Such a determination may be based on the availability of reliable or low-latency network connections or on a desire for higher quality audio presentations than may otherwise be generated on the client device 104 due to lack of storage or computing capacity.

At decision block 512, if the analysis component 150 determines that no voice transfer to the client device 104 or removal from the client device 104 is indicated by the usage data 152, then the process 500 may return to block 504 to continue monitoring. Otherwise, if the analysis component 150 determines, for example, that a voice has been utilized more than a threshold number of times or a threshold percentage of times, the voice data may be retrieved from the remote TTS system 102 or some other voice server for storage in the voice data store 144 at block 514. The analysis component 150 or some other component of the client device 104 may further determine a preferred time or method to retrieve the voice data for storage on the client device 102, such as when the client device 104 is connected to a high speed network connection.

For example, a mobile phone may be configured to connect to the internet via a cellular phone network, for which the user of the phone is charged a per-unit rate for data transfer. The same mobile phone may also be capable of connecting to a LAN without such per-unit charges, such as through a wireless access point within a home or place of business. The analysis component 150 may determine that downloading the voice data to the mobile phone is only to occur when the mobile phone has such a network connection. The analysis component 150 may have access to data regarding the connection available to the device. Optionally, a client device 104 or user thereof may be associated with a profile which indicates the various network connections available to the cent device 104.

Terminology

Depending on the embodiment, certain acts, events, or functions of any of the processes or algorithms described herein can be performed in a different sequence, can be added, merged, or left out altogether (e.g., not all described operations or events are necessary for the practice of the algorithm). Moreover, in certain embodiments, operations or events can be performed concurrently, e.g., through multi-threaded processing, interrupt processing, or multiple processors or processor cores or on other parallel architectures, rather than sequentially.

The various illustrative logical blocks, modules, routines, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, routine, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or any combination thereof. Thus, such conjunctive language is not generally intended to imply that certain embodiments require at least one of X, at least one of Y and at least one of Z to each be present.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A non-transitory computer storage medium which stores an executable code module that directs a client computing device to perform a process comprising:

receiving, via a first interface, a first request to generate a first audio presentation of a first text input, the first request indicating a first voice with which to generate the first audio presentation;

selecting a second interface using a characteristic of the client computing device, wherein the second interface is an interface to a local text-to-speech module;

using the second interface to generate the first audio presentation;

receiving, via the first interface, a second request to generate a second audio presentation of a second text input, the second request indicating a second voice with which to generate the second audio presentation;

selecting a third interface using the characteristic of the client computing device, wherein the third interface is an interface to a remote text-to-speech server; and using the third interface to generate the second audio presentation.

2. The non-transitory computer storage medium of claim 1, wherein the characteristic comprises one or more of: a presence of a network connection; a latency of the network connection; a presence of data corresponding to the first voice on the client computing device; or a type of application requesting the audio presentation.

3. The non-transitory computer storage medium of claim 1, wherein the process further comprises:

determining whether to store data corresponding to the second voice on the client computing device based at least on usage data regarding previous requests for audio presentations; and receiving the data corresponding to the second voice from a server for storage on the client computing device.

4. The non-transitory computer storage medium of claim 1, wherein the interface is an application programming interface.

5. The non-transitory computer storage medium of claim 1, wherein the process further comprises:

performing one or more preprocessing operations to the first text input prior to using the second interface to generate the first audio presentation.

6. A computer-implemented method comprising:

receiving, by a computing device comprising one or more processors, a first request to generate a first audio representation of a first text;

determining, based at least on a first characteristic of the computing device, to use a local text-to-speech module to generate the first audio representation;

generating the first audio representation using the local text-to-speech module;

receiving a second request to generate a second audio representation of a second text;

determining, based at least on a second characteristic of the computing device, to use a remote text-to-speech system to generate the second audio representation;

sending the second text to the remote text-to-speech system; and receiving the second audio representation from the remote text-to-speech system.

7. The computer-implemented method of claim 6, wherein the first characteristic comprises one of: an absence of a network connection; a latency of an available network connection; a presence of voice data on the computing device; a computing capability of the computing device; or a type of application requesting the audio representation.

8. The computer-implemented method of claim 6, wherein the second characteristic comprises one of: a presence of a network connection; a low latency of an available network connection; an absence of voice data on the computing device; a computing capability of the computing device; or a type of application requesting the audio representation.

9. The computer-implemented method of claim 6, wherein determining to use a remote text-to-speech system is further based on at least a desired quality for the second audio representation.

10. The computer-implemented method of claim 6, wherein generating the first audio representation comprises using a voice specified in the first request and wherein the local text-to-speech module uses a statistical parametric approach to generate the first audio representation.

11. The computer-implemented method of claim 6, further comprising performing one or more preprocessing operations to the second text.

12. The computer-implemented method of claim 11, wherein the one or more of preprocessing operations comprises at least one of: symbol expansion, homograph disambiguation, or conversion of text into a sequence of subword units.

13. The computer-implemented method of claim 6, wherein the first request comprises an indication of a preferred voice; wherein the preferred voice is not available on the computing device; and wherein generating the first audio representation comprises using a voice that is not the preferred voice.

14. The computer-implemented method of claim 6, further comprising:

determining to store second voice data on the computing device based at least on usage data regarding previous requests for audio representations, the second voice data corresponding to the second voice; and receiving the second voice data from a server for storage on the computing device.

15. The computer-implemented method of claim 6, further comprising:

receiving a selection of third voice data to store on the computing device; and receiving the third voice data from a server for storage on the computing device.

16. The computer-implemented method of claim 15, wherein the third voice data is received in response to determining that the computing device has access to a network connection associated with a level of bandwidth exceeding a threshold.

17. The computer-implemented method of claim 6, wherein the process further comprises:

determining to remove third voice data from the computing device based at least on usage data regarding previous requests for audio representations; and removing the third voice data from the computing device.

18. A system comprising:

a computing device comprising one or more processors, the one or more processors programmed by specific executable instructions to at least:

receive a first request to generate a first audio representation of a first text;

determine, based at least on a first characteristic of the computing device, to use a local text-to-speech module to generate the first audio representation;

generate the first audio representation using the local text-to-speech module;

receive a second request to generate a second audio representation of a second text;

determine, based at least on a second characteristic of the computing device, to use a remote text-to-speech system to generate the second audio representation;

send request data based at least in part on the second text to the remote text-to-speech system; and receive the second audio representation from the remote text-to-speech system.

19. The system of claim 18, wherein the first characteristic comprises at least one of: an absence of a network connection; a latency of an available network connection; a presence of the first voice data on the computing device; a computing capability of the computing device; or a type of application requesting the audio representation.

20. The system of claim 18, wherein the second characteristic comprises at least one of: a presence of a network connection; a low latency of an available network connection; an absence of the first voice data on the computing device; a computing capability of the computing device; or a type of application requesting the audio representation.

21. The system of claim 18, wherein the one or more processors are further programmed to determine to use a remote text-to-speech system based at least on a desired quality for the second audio representation.

22. The system of claim 18, wherein the one or more processors are further programmed to generate the first audio representation using a voice specified in the first request wherein the local text-to-speech module uses a statistical parametric approach to generate the first audio representation.

23. The system of claim 22, wherein the one or more processors are further programmed to perform one or more preprocessing operations to the second text.

24. The system of claim 23, wherein the one or more preprocessing operations comprises at least one of: symbol expansion, homograph disambiguation, or conversion of text into a sequence of subword units.

25. The system of claim 18, wherein the first request comprises an indication of a preferred voice, wherein the preferred voice is not available on the computing device, and wherein generating the first audio representation comprises using a voice that is not the preferred voice.

26. The system of claim 18, wherein the one or more processors are further programmed to:

determine to store second voice data on the computing device based at least on usage data regarding previous requests for audio representations, the second voice data corresponding to the second voice; and receive the second voice data from a server for storage on the computing device.

27. The system of claim 18, wherein the one or more processors are further programmed to receive a selection of third voice data to store on the computing device; and receive the third voice data from a server for storage on the computing device.

28. The system of claim 27, wherein the third voice data is received in response to determining that the computing device has access to a network connection associated with a level of bandwidth exceeding a threshold.

29. The system of claim 18, wherein the one or more processors are further programmed to determine to remove third voice data from the computing device based at least on usage data regarding previous requests for audio representations; and remove the third voice data from the computing device.

30. The system of claim 18, wherein the computing device comprises a mobile phone, tablet computing device, media consumption device, electronic book reading device, or a mobile computing device.

* * * * *